US011756391B2

(12) United States Patent
Deshpande et al.

(10) Patent No.: US 11,756,391 B2
(45) Date of Patent: Sep. 12, 2023

(54) VOICE ALARM DEVICE

(71) Applicant: Johnson Controls Fire Protection LP, Boca Raton, FL (US)

(72) Inventors: Praveen Deshpande, Pune (IN); Faruk Meah, Surrey (GB); Prasad Kulkarni, Berkshire (GB)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 17/430,176

(22) PCT Filed: Feb. 12, 2020

(86) PCT No.: PCT/EP2020/053660

§ 371 (c)(1),
(2) Date: Aug. 11, 2021

(87) PCT Pub. No.: WO2020/165289

PCT Pub. Date: Aug. 20, 2020

(65) Prior Publication Data

US 2022/0101700 A1 Mar. 31, 2022

(30) Foreign Application Priority Data

Feb. 12, 2019 (GB) ..... 1901938

(51) Int. Cl.

| | |
|---|---|
| ***G08B 3/10*** | (2006.01) |
| ***G08B 17/00*** | (2006.01) |
| ***G08B 25/04*** | (2006.01) |
| ***G08B 27/00*** | (2006.01) |

(52) U.S. Cl.
CPC ..... *G08B 3/10* (2013.01); *G08B 17/00* (2013.01); *G08B 25/04* (2013.01); *G08B 27/005* (2013.01)

(58) Field of Classification Search
CPC ..... G08B 3/10
See application file for complete search history.

(56) References Cited

U.S. PATENT DOCUMENTS 6,313,744 B1 * 11/2001 Capowski ..... G08B 25/14 340/517
7,403,096 B2 7/2008 Curran et al.
2005/0088313 A1 4/2005 LeBlanc et al.
(Continued)

FOREIGN PATENT DOCUMENTS

CN 103077576 B 7/2014
EP 2 434 464 A1 3/2012
(Continued)

OTHER PUBLICATIONS

International Preliminary Report on Patentability, dated Aug. 26, 2021, from International Application No. PCT/EP2020/053660, filed on Feb. 12, 2020. 10 pages.
(Continued)

*Primary Examiner* — Travis R Hunnings
(74) *Attorney, Agent, or Firm* — ArentFox Schiff LLP

(57) ABSTRACT

The present invention relates to a voice alarm device which forms part of a fire alarm system loop. Upon detection of a fire, a control panel instructs appropriate voice alarm devices to retrieve relevant audio from local storage and output the audio via a local speaker.

6 Claims, 4 Drawing Sheets

(56) References Cited

U.S. PATENT DOCUMENTS

| | | | | |
|---|---|---|---|---|
| 2006/0071802 | A1* | 4/2006 | Right | G08B 3/10 340/628 |
| 2010/0295677 | A1* | 11/2010 | Egawa | G08B 25/009 340/540 |
| 2014/0241533 | A1 | 8/2014 | Gerrish et al. | |

FOREIGN PATENT DOCUMENTS

| | | | | |
|---|---|---|---|---|
| EP | 3 029 644 | A1 | | 6/2016 |
| GB | 2471860 | A | | 1/2011 |
| JP | 2009003494 | A | * | 1/2009 |
| WO | WO 03/012759 | | | 2/2003 |

OTHER PUBLICATIONS

International Search Report and Written Opinion of the International Searching Authority, dated Mar. 31, 2020, from International Application No. PCT/EP2020/053660, filed on Feb. 12, 2020. 15 pages.

Search and Examination Report dated Aug. 12, 2019, from United Kingdom Application No. GB1901938.9, filed on Feb. 12, 2019. 7 pages.

* cited by examiner

VOICE ALARM DEVICE

RELATED APPLICATIONS

This application is a § 371 National Phase Application of International Application No. PCT/EP2020/053660, filed on Feb. 12, 2020, now International Publication No. WO 2020/165289 A1, published on Aug. 20, 2020, which International Application claims priority to GB Application 1901938.9, filed on Feb. 12, 2019, both of which are incorporated herein by reference in their entirety.

FIELD OF THE INVENTION

Embodiments of the present invention relate generally to a voice alarm device. More specifically they relate to a voice alarm device which forms part of a fire alarm system.

BACKGROUND OF THE INVENTION

Building safety regulations in many countries require the installation of both a fire alarm system and a public address and voice alarm (PAVA) system.

The fire alarm system comprises a fire alarm panel (sometimes known as control and indicating equipment (CIE)), a plurality of signaling loop (SLC) devices (also referred to as detector devices), such as smoke detectors, and a plurality of notification (NAC) devices, such as strobe lights and sounders. The SLC devices are connected using an addressable two-wire loop extending from the fire alarm panel, which enables each of the SLC devices to be addressable by the fire alarm panel and makes their connections more robust. Upon detection of an alarm condition at any of the SLC devices, an alarm signal is sent to the fire alarm panel, which activates an alarm condition and sends an alarm condition signal addressed to NAC devices causing the NAC devices to output safety notifications. The NAC devices are only capable of simple notifications: tones in the case of a sounder; and a flashing light in the case of a strobe light.

The PAVA system enables audible information to be presented to occupants of a building. For example, a PAVA system may be used to play background music. Alternatively, the system may be used to make announcements to all, or some, of the occupants of the building. PAVA systems generally include a central panel which connects to all of the devices within the system. Audio inputs for the system may originate from local/remote storage, a paging microphone located in a security office or an emergency public address microphone attached to the central panel itself. PAVA system outputs comprise single-wire lines, such as speaker lines or strobe lines. Speaker lines typically comprise a plurality of 100V speakers for outputting an audio signal at a given area.

PAVA systems and fire alarm systems are generally required to meet different standards of functionality and, as such, often have differing architectural arrangements. For example, as discussed above, SLC devices within a fire alarm system are provided within a two-wire loop system, to minimise the chance of unmonitored areas of a monitored site due to, for example, a broken wire.

In light of the above, PAVA systems and fire alarm systems are often installed side-by-side within a building. A communication pathway is introduced between the two systems such that, if an alarm condition is detected, the fire alarm panel can instruct the PAVA system to output an appropriate audio signal. This has a substantial benefit because voice alarm messages can be output from the PAVA which instructs people within the building on the action they must take. This has been shown to reduce injuries and fatalities from fires and from the evacuation process as well.

However, installation of both a PAVA system and a fire alarm system can be expensive. At locations which only require the monitoring of a small number of rooms, the cost of installing a PAVA system can significantly outweigh the benefit. Additionally, in some countries, PAVA systems are not mandatory, and only fire alarm systems are installed which provide minimal audible signals to building occupants.

WO 03/012759 A1 is directed to a fire alarm system comprising one or more fire alarm addressable modules which interface with a fire alarm loop and a voice alarm system comprising one or more amplifiers connected to respective speakers. However, close proximity of speakers will cause voice messages to be difficult to hear when a person can hear two different messages at the same time.

GB 2471860 A refers to a signal for use on a wired network interconnecting electronic devices comprising a base voltage, a pulsed voltage signal and a digital signal, and to detector apparatuses with voice data capabilities of a wired network for power conservation and backwards compatibility. This constrains the installation of the system because its speakers will be located in places which are good for detecting fires, but not in places which are optimal for alerting people.

EP 2434464 A1 is directed to a hazard detector for acoustic signaling of a hazard, which is provided for switching on a detector line, in particular a two-wire line, and which has a receiving unit for receiving alarm information transmitted via the detector line in the event of danger. The hazard detector has at least one electroacoustic transducer for voice output. This constrains the installation of the system because its speakers will be located in places which are good for detecting fires, but not in places which are optimal for alerting people.

As such, there remains a need for a cost-effective means of outputting audible voice signals within a fire alarm system.

SUMMARY OF THE INVENTION

In order to solve the problems associated with the prior art, the present invention provides a fire alarm system, comprising: a control panel, arranged to control one or more devices on an addressable fire alarm loop; one or more detector devices, arranged to send an alarm condition signal to the control panel upon detection of an alarm condition; and a plurality of voice alarm devices, as separate devices from the one or more detector devices, arranged to output an audible alarm message upon receipt of an alarm output signal from the control panel, the voice alarm devices further comprising: a loop connection interface, arranged to connect the at least one voice alarm device to the fire alarm loop; a processor, arranged to process signals received via the fire alarm loop; at least one memory, arranged to store one or more audio files; and a speaker, arranged to output the one or more audio files, wherein the processors of the voice alarm devices are configured to process timing information so that voice alarm devices in close proximity to each other have synchronised audio.

As will be appreciated, the present invention provides several advantages over the prior art. For example, the fire alarm system of the present invention provides some of the benefits of a PAVA system without requiring the corresponding installation cost and effort.

The fire alarm loop may use a two-wire communication protocol to enable signaling between devices on the fire alarm loop.

The fire alarm system may further comprise a plurality of voice alarm devices, arranged to output an audible alarm message upon receipt of an alarm output signal from the control panel, wherein the alarm output signal from the control panel comprises timing information, defining a point in time at which the audio file should be output by each of the plurality of voice alarm devices.

The one or more audio files may comprise at least one of a voice alarm message, a system test message and music.

In a further embodiment of the present invention there is provided a voice alarm device, arranged to connect to an addressable fire alarm loop of a fire alarm system separate from a detector device of the system, the voice alarm device comprising: a loop connection interface, arranged to connect the at least one voice alarm device to the fire alarm loop; a processor, arranged to process signals received via the fire alarm loop; at least one memory, arranged to store one or more audio files; and a speaker, arranged to output the one or more audio files; wherein the processor of the voice alarm device is configured to process timing information so that the voice alarm device has audio which is synchronised with the timing information.

In particular, the voice alarm devices according to some embodiments of the present invention are discrete from the detector devices of a fire alarm system. The advantage over the prior art is the provision of the specific and complementary function of the voice alarm to support the operations of the fire alarm system upon receipt of an alarm output signal, in a way that is independent from the detection system, so that the processing needed for the voice alarm function does not constitute a burden for the control panel or the loop.

The processing capabilities of the processor in each voice alarm device according to the present invention provide for processing timing information so that voice alarm devices in close proximity to each other may have synchronised audio, therefore preventing individual voice alarm devices from obscuring each other's outputs; whereas existing devices may only be capable of reading and outputting timing information, without providing for synchronization of the units in the system through a logic internal to each unit.

The loop connection interface may be arranged for use with a two-wire communication protocol.

The processor may be further arranged to determine, based on the received signal, timing information and output the audio file through the speaker at a corresponding time.

The audible alarm message may comprise at least one of a voice alarm message, a system test message and music.

BRIEF DESCRIPTION OF THE DRAWINGS

Other advantages and benefits of embodiments of the present invention will become apparent from a consideration of the following description and accompanying drawings, in which.

DETAILED DESCRIPTION

Figure 1:
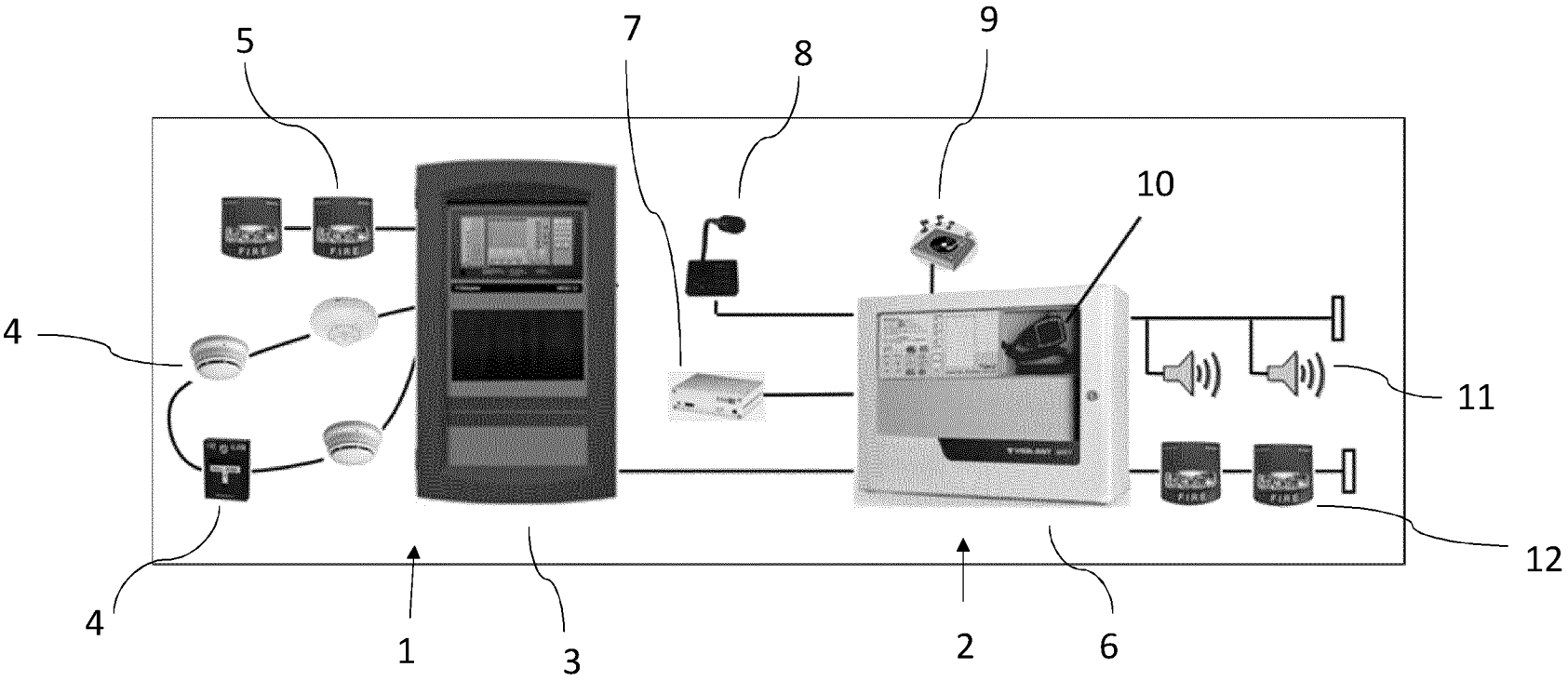
Figure 1 (Prior Art)
FIG. 1 shows an example of the prior art.

Known systems, an example of which is shown in FIG. 1, comprise a fire alarm system 1 and a public address and voice alarm (PAVA) system 2 which are in communication with each other.

The fire alarm system 1 comprises a control panel 3, which acts as a centre point to which other devices in the system 1 are connected. A plurality of signaling loop (SLC) devices 4 (some of which are fire detector devices) are arranged along a two-wire addressable loop, each end of which is connected to the control panel 3. In this manner, if any part of the two-wire loop becomes faulty, the remaining SLC devices 4 are still able to communicate with the control panel 3. The SLC devices 4 are arranged to indicate that a fire may be present within a monitored building. For example, an SLC device 4 may be a smoke alarm, a fire alarm, a manual call point or any kind of device which is capable of indicating the presence of a fire.

The fire alarm system 1 also comprises a plurality of notification (NAC) devices 5. In the event that one or more of the SLC devices 4 indicate the presence of a fire, an addressed signal is sent from the control panel 3, to one or more of the NAC devices 5, in order to alert any occupants of the monitored building to the presence of the fire. For example, an NAC device 5 may be a strobe light, an LED sign, a sounder or any other kind of notification device. A sounder, in the present sense, relates to a device arranged to produce an audible output directly from an electrical input. As such, a sounder is only capable of producing an extremely limited set of sounds/tones. In this manner, the fire alarm system 1, alone, is only capable of outputting basic lighting and audio tone notifications.

In a similar manner to the fire alarm system 1, the PAVA system 2 comprises a central panel 6 which is arranged to coordinate interactions between a series of inputs and a series of outputs. The central panel 6 may receive audio inputs from any one of a remote storage unit 7, a paging microphone 8, a music device 9 and an emergency microphone 10. Audio received at each of these inputs is passed through the central panel 6 and is output by one or more speakers 11, which are connected via a one-wire speaker line. The central panel 6 of the PAVA system 2 may also be connected to further outputs, such as a strobe output 12, for outputting further information.

In the event that one of the SLC devices 4 of the fire alarm system 1 indicates the presence of a fire, the control panel 3 sends a signal to the central panel 6 of the PAVA system 2. In response, the central panel 6 retrieves the appropriate audio file from the remote storage unit 7 and outputs it through the speakers 11. Further information may be provided to building occupants through the paging microphone 8 or the emergency microphone 10.

Figure 2:
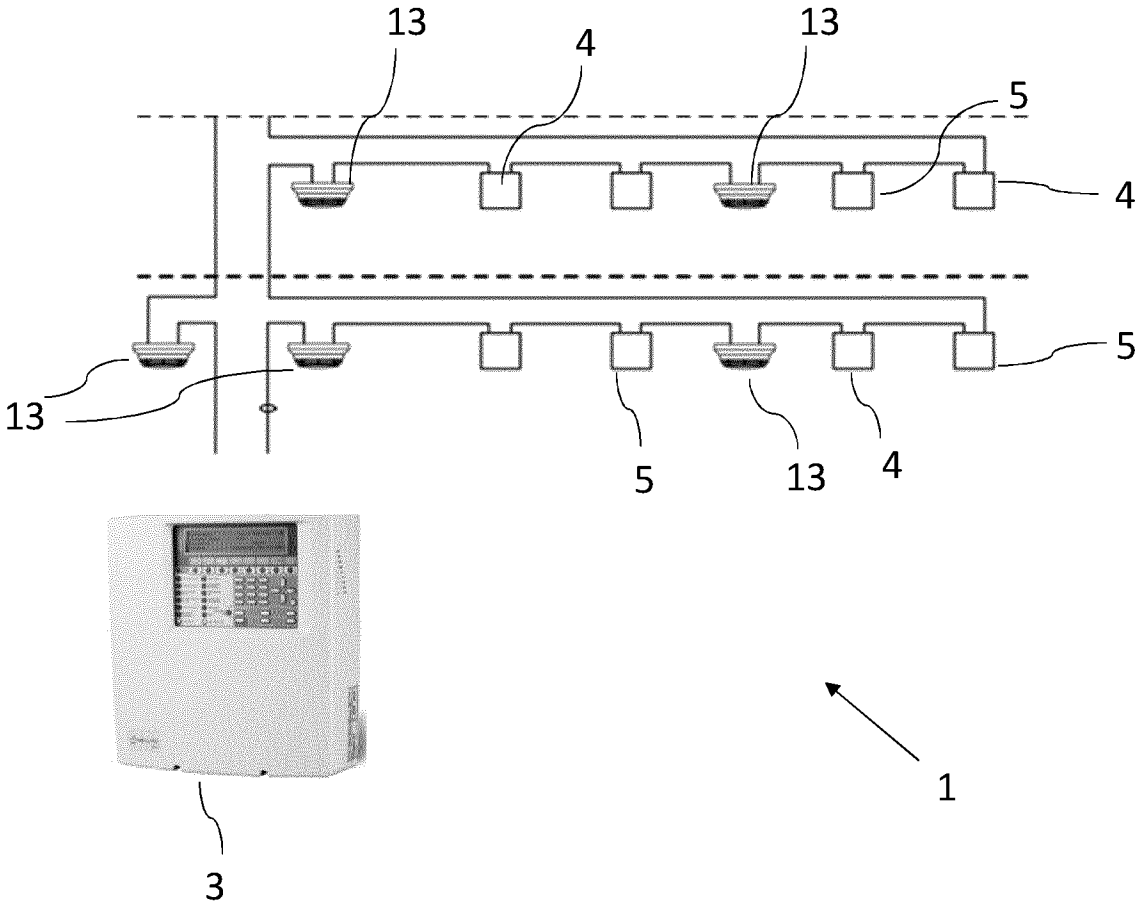
FIG. 2 shows a schematic of a fire alarm system of the present invention.

Referring now to FIG. 2, there is presented a schematic of a fire alarm system 1 in accordance with the present invention. As with the prior art, the fire alarm system 1 of the present invention comprises a control panel 3 arranged to monitor a series of SLC devices 4. In the event that one or more of the SLC devices 4 output a signal indicative of a fire, the control panel 3 outputs an alarm signal to one or more NAC devices 5 in order to alert any building occupants.

The fire alarm system 1 uses an addressable two-wire loop for connecting to each device 4, 5 in the system. The loop enables the control panel 3 to provide both data and power to each of the devices 4, 5 on the loop. Further, if the loop becomes faulty at any individual point, the devices 4, 5 on the loop are still capable of receiving power and date from the control panel 3.

The addressable two-wire loop enables the control panel 3 to determine from which SLC device 4 a signal was received. In this manner, the control panel 3 is then able to provide information to a user regarding the location of an alarm condition. Similarly, the addressable nature of the system allows the control panel 3 to send appropriate signals to NAC devices 5 which are in close proximity to the relevant SLC devices 4.

An SLC device 4 may be a smoke alarm, a fire alarm, a manual call point or any kind of device which is capable of indicating the presence of a fire. An NAC device 5 may be a strobe light, an LED sign, a sounder or any other kind of notification device.

However, in contrast to the prior art, the fire alarm system 1 of the present invention further includes one or more voice alarm devices (VAD) 13 on the two-wire loop. Each VAD 13 is arranged to output an audio signal in the event of an alarm condition. However, each VAD 13 contains a processor and a memory, such that different audio signals can be output in different situations.

In an example, in the event of an initial alarm condition in which the occupants of a building are not required to evacuate, each VAD 13 is arranged to output a first audio signal, informing building occupants that an alarm condition has been raised. Once a fire has been confirmed, each VAD 13 is then arranged to output a second audio signal, requesting building occupants to vacate the building.

By including VADs 13 on the two-wire loop, each VAD 13 can be addressable by the control panel 3. In contrast, prior art systems which use a PAVA system 2 do not have individually addressable speakers 11. Further, in using multiple VADs 13 in this manner, the two-wire loop system is capable of handling synchronisation between each VAD 13. This is crucial for interpretation of voice messages in an alarm situation.

Further, by including VADs 13 within the two-wire loop of the fire alarm system 1, some of the benefits of a PAVA system 2 are enabled within the fire alarm system 1. As such, in smaller buildings where PAVA systems 2 are not required, the audible benefits of using a PAVA system 2 in conjunction with the fire alarm system 1 are maintained.

The installation of VADs 13 within a fire alarm system 1 requires only the installation of the individual devices, and a small amount of surrounding infrastructure. As such, the introduction of VADs 13 to a fire alarm system 1 has minimal effect on fire alarm installation costs. In this manner, VADs 13 can also be retroactively fitted into a fire alarm system 1.

Figure 3:
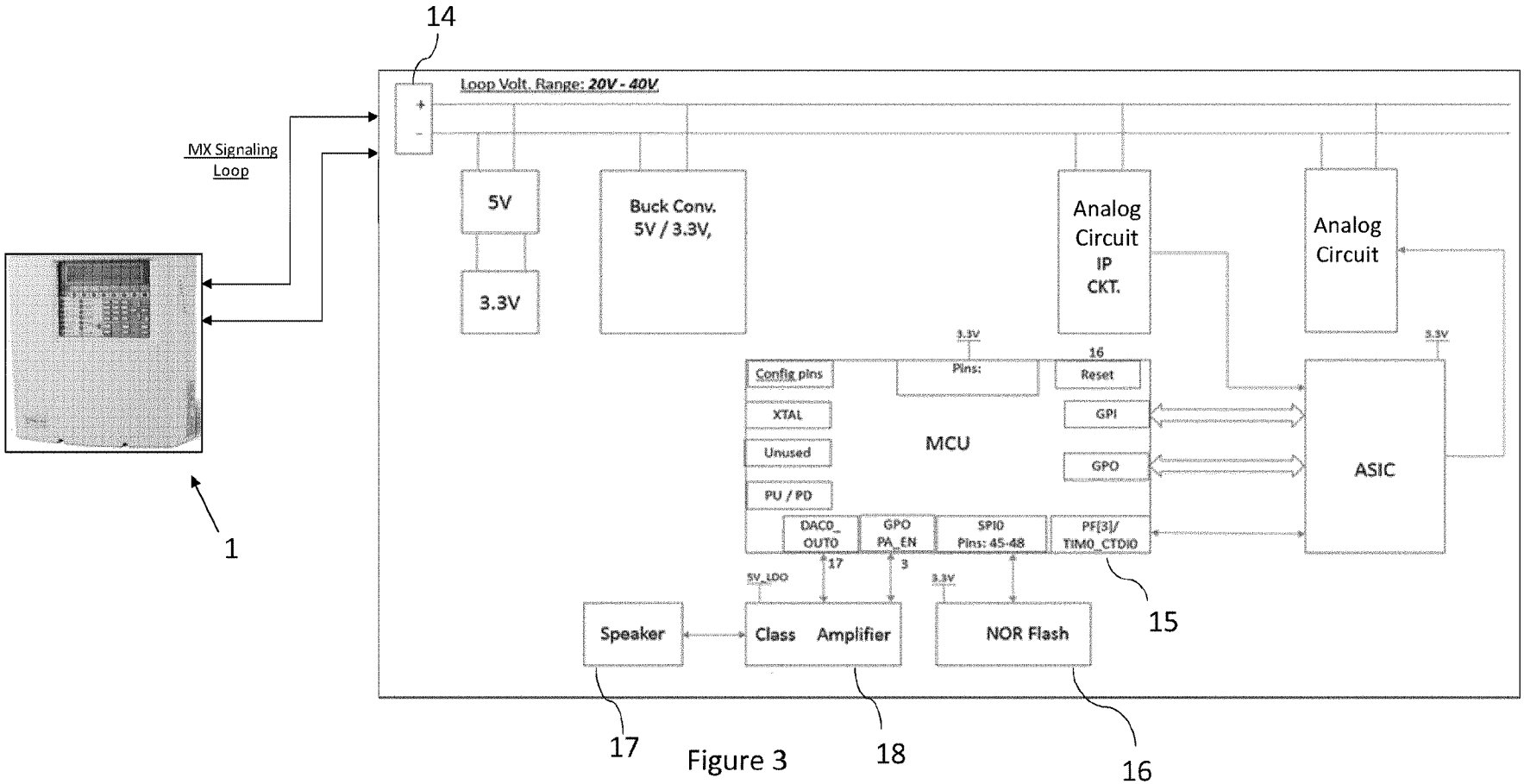
FIG. 3 shows a schematic of a VAD in accordance with the present invention.

Referring now to FIG. 3, the components of a VAD 13 are shown in a detailed schematic. The VAD 13 comprises a loop connection interface 14 arranged to receive electrical signals from the two-wire signaling loop of the fire alarm system 1.

Signals received from the two-wire loop are sent to a processor 15 for processing. After processing a signal, the processor 15 retrieves an appropriate audio file from a memory 16 and outputs it through a speaker 17, via an amplifier 18.

Audio files stored in the memory 16 of the VAD 13 are installed during manufacture of the device, removing the need to provide a high bandwidth data connection to the VAD 13.

Figure 4:
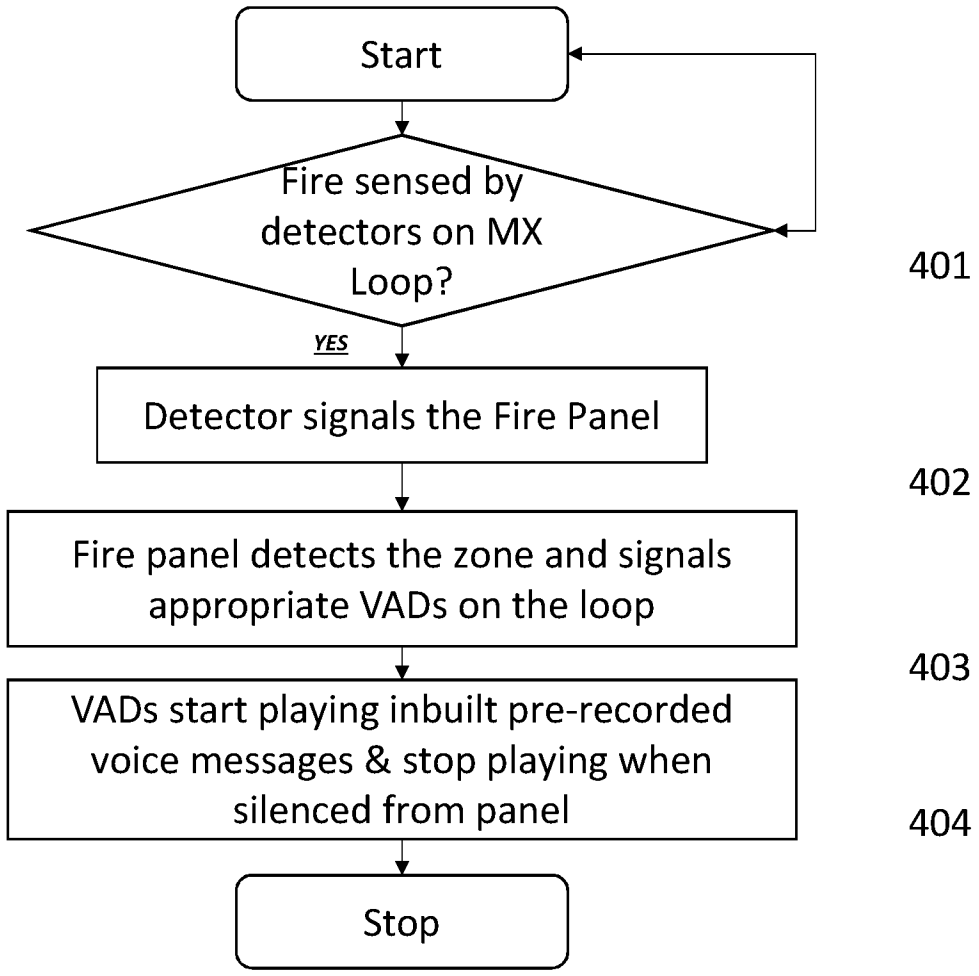
FIG. 4 shows a method of enabling a VAD in accordance with the present invention.

With reference to FIG. 4, a method of alerting the occupants of a building to the existence of a fire is described. At a first step 401, SLC devices 4, which are monitoring the building, determine whether a fire has been sensed. If no fire is sensed, the SLC devices 4 continue to monitor for indications of a fire.

If a fire is detected by an SLC device 4, at step 402, that device sends a signal to the control panel 3.

At step 403, the control panel 3 determines which SLC device 4 sent the signal and sends an alarm signal to a corresponding VAD 13 near to that SLC device 4.

At step 404, upon receipt of the alarm signal, the VAD 13 starts outputting the requested audio file through its speaker 17. The VAD 13 continues to output the audio file until it receives a further signal to stop.

The alarm signal sent from the control panel 3 may contain timing information defining a point in time at which the audio file should be output by the VAD 13. In this manner, when instructing multiple VADs 13 at the same time, the control panel 3 can ensure that VADs 13 in close proximity to each other have synchronised audio, preventing individual VADs 13 from obscuring each other's outputs.

In order to implement the timing information, the processor 15 of each VAD 13 is arranged to determine, based on the alarm signal, the indicated timing and output the audio file through the speaker 17 at the corresponding time.

The skilled person will also realise that steps of various above-described methods can be performed by programmed computers. Accordingly the above-mentioned embodiments should be understood to cover storage devices containing machine-executable or computer-executable instructions to perform some or all of the steps of the above-described methods. The embodiments are also intended to cover computers programmed to perform the steps of the above-described methods.

The functionality of the elements shown in the Figures can be provided using either dedicated hardware and/or software. The expressions "processing", "processing means" and "processing module" can include, but is not limited to, any of digital signal processor (DSPs) hardware, network processors, application specific integrated circuits (ASICs), field programmable gate arrays (FPGAs). Similar, "memory" can include, but is not limited to, read only memories (ROMs) for storing software, random access memories (RAMs), and non-volatile storage.

Features of the present invention are defined in the appended claims. While particular combinations of features have been presented in the claims, it will be appreciated that other combinations, such as those provided above, may be used.

The invention claimed is:

1. A fire alarm system combined with a plurality of voice alarm devices, the fire alarm system comprising:

a control panel arranged to control one or more devices on an addressable fire alarm loop;

one or more detector devices arranged to send an alarm condition signal to the control panel upon detection of an alarm condition; and one or more notification devices arranged to receive an alarm output signal from the control panel, wherein the plurality of voice alarm devices are separate devices from the one or more detector devices and the one or more notification devices and are arranged to output an audible alarm voice message upon receipt of an alarm output signal from the control panel, the voice alarm devices comprising:

a loop connection interface for retroactively fitting the voice alarm devices to the fire alarm loop, arranged to connect the voice alarm devices to the fire alarm loop;

a processor, arranged to process signals received via the fire alarm loop;

at least one memory, arranged to store one or more audio files; and a speaker, arranged to output the one or more audio files, wherein the processors of the voice alarm devices are configured to process timing information so that voice alarm devices in close proximity to each other have synchronized audio; and wherein the alarm output signal from the control panel comprises timing information, defining a point in time at which a selected audio file of the one or more audio files should be output by each of the plurality of voice alarm devices to synchronize the audio to be reproduced at different periods from each other.

2. The fire alarm system of claim 1, wherein the fire alarm loop uses a two-wire communication protocol to enable signaling between devices on the fire alarm loop.

3. The fire alarm system of claim 1, wherein the one or more audio files comprise at least one of a voice alarm message, a system test message and music.

4. A voice alarm device, arranged to connect to an addressable fire alarm loop of a fire alarm system, separate from a detector device and a notification device of the system, the voice alarm device comprising:

a loop connection interface for retroactively fitting voice alarm devices to the fire alarm loop, arranged to connect the voice alarm device to the fire alarm loop;

a processor arranged to process signals received via the fire alarm loop;

at least one memory arranged to store one or more audio files; and a speaker arranged to output the one or more audio files;

wherein the processor of the voice alarm device is configured to process timing information so that the voice alarm device has audio which is synchronized with the timing information; and wherein the processor is further arranged to determine, based on at least one of the signals, the timing information and output one of the audio files through the speaker at a corresponding time to synchronize the audio to be reproduced at different periods from each other.

5. The voice alarm device of claim 4, wherein the loop connection interface is arranged for use with a two-wire communication protocol.

6. The voice alarm device of claim 5, wherein the one or more audio files comprise at least one of a voice alarm message, a system test message and music.

* * * * *